US007932217B2

(12) United States Patent
Hee et al.

(10) Patent No.: US 7,932,217 B2
(45) **Date of Patent: *Apr. 26, 2011**

(54) GEAR OIL COMPOSITIONS, METHODS OF MAKING AND USING THEREOF

(75) Inventors: Allan G. Hee, Albany, CA (US); Trevor Miller, Oakland, CA (US)

(73) Assignee: Chevron U.S.A., Inc., San Ramon, CA (US)

( * ) Notice: Subject to any disclaimer, the term of this patent is extended or adjusted under 35 U.S.C. 154(b) by 400 days.

This patent is subject to a terminal disclaimer.

(21) Appl. No.: 12/133,166

(22) Filed: Jun. 4, 2008

(65) Prior Publication Data

US 2009/0062164 A1 Mar. 5, 2009

Related U.S. Application Data

(63) Continuation-in-part of application No. 11/845,905, filed on Aug. 28, 2007.

(51) Int. Cl.
*C10M 169/04* (2006.01)
*C10G 17/00* (2006.01)

(52) U.S. Cl. ..... 508/110; 208/18

(58) Field of Classification Search ..... 508/110; 208/18

See application file for complete search history.

(56) References Cited

U.S. PATENT DOCUMENTS 4,370,247 A 1/1983 Ostyn
4,704,215 A 11/1987 Hata et al.
5,043,497 A 8/1991 Muraki et al.
6,059,955 A 5/2000 Cody et al.
6,096,940 A 8/2000 Wittenbrink et al.
6,150,577 A 11/2000 Miller et al.
6,392,108 B1 5/2002 O'Rear et al.
6,506,297 B1 1/2003 Wittenbrink et al.
6,518,321 B1 2/2003 O'Rear et al.
6,579,441 B1 6/2003 Biscardi et al.
6,589,415 B2 7/2003 Smith et al.
6,627,779 B2 9/2003 O'Rear et al.
6,656,342 B2 12/2003 Smith et al.
6,699,385 B2 3/2004 Miller et al.
6,703,353 B1 3/2004 Lok et al.
6,713,657 B2 3/2004 O'Rear et al.
6,773,578 B1 8/2004 O'Rear et al.
6,774,272 B2 8/2004 Miller et al.
6,806,237 B2 10/2004 O'Rear et al.
6,822,126 B2 11/2004 Miller et al.
6,833,065 B2 12/2004 O'Rear et al.
6,833,484 B2 12/2004 O'Rear et al.

(Continued)

FOREIGN PATENT DOCUMENTS

WO WO2006/003119 1/2006

*Primary Examiner* — Glenn Caldarola
*Assistant Examiner* — Jim Goloboy
(74) *Attorney, Agent, or Firm* — Penny L. Prater

(57) ABSTRACT

A gear oil composition is provided. The composition comprises a synergistic amount of an isomerized base oil having consecutive numbers of carbon atoms and less than 10 wt % naphthenic carbon by n-d-M for the gear oil composition to have a traction coefficient at 15 $mm^2/s$. of less than 0.030 and a pressure viscosity coefficient of at least 15.0 at 80° C., 20 Newton load, and 1.1 m/s rolling speed. In one embodiment, the sufficient amount of isomerized base oil ranges from 20 to 80 wt. % based on the total weight of the gear oil composition.

20 Claims, 2 Drawing Sheets

U.S. PATENT DOCUMENTS 6,878,854 B2 4/2005 O'Rear et al.
6,890,423 B2 5/2005 O'Rear et al.
6,900,366 B2 5/2005 Rosenbaum et al.
6,924,404 B2 8/2005 O'Reilly et al.
6,962,651 B2 11/2005 Miller et al.
7,018,525 B2 3/2006 Miller et al.
7,045,055 B2 5/2006 Ziemer et al.
7,053,254 B2 5/2006 Miller et al.
7,067,049 B1 6/2006 Baillargeon et al.
7,083,713 B2 8/2006 Abernathy et al.
7,141,157 B2 11/2006 Rosenbaum et al.
7,144,497 B2 12/2006 Lok et al.
2004/0159582 A1 8/2004 Simmons et al.
2004/0176256 A1* 9/2004 Kurosawa et al. ..... 508/110
2004/0181110 A1 9/2004 Miller et al.
2004/0232045 A1 11/2004 Simmons et al.
2004/0256286 A1 12/2004 Miller et al.
2004/0256287 A1 12/2004 Miller et al.
2005/0059563 A1 3/2005 Sullivan et al.
2005/0077208 A1 4/2005 Miller et al.
2005/0133407 A1 6/2005 Abernathy et al.
2005/0133409 A1 6/2005 Abernathy et al.
2005/0139513 A1 6/2005 Miller et al.
2005/0139514 A1 6/2005 Miller et al.
2005/0241990 A1* 11/2005 Ziemer et al. ..... 208/19
2005/0247600 A1 11/2005 Miller et al.
2005/0258078 A1 11/2005 Rosenbaum et al.
2005/0261145 A1 11/2005 Rosenbaum et al.
2005/0261146 A1 11/2005 Rosenbaum et al.
2005/0261147 A1 11/2005 Rosenbaum et al.
2006/0016721 A1 1/2006 Miller et al.
2006/0016724 A1 1/2006 Miller et al.
2006/0027486 A1 2/2006 Rosenbaum et al.
2006/0065573 A1 3/2006 Dieckmann et al.
2006/0069295 A1 3/2006 Dieckmann et al.
2006/0069296 A1 3/2006 Dieckmann et al.
2006/0070914 A1 4/2006 Miller et al.
2006/0076266 A1 4/2006 Miller et al.
2006/0076267 A1 4/2006 Miller et al.
2006/0091043 A1 5/2006 Miller et al.
2006/0113216 A1 6/2006 Rosenbaum et al.
2006/0113512 A1* 6/2006 Rosenbaum et al. ..... 252/570
2006/0131210 A1 6/2006 Rosenbaum et al.
2006/0178279 A1 8/2006 Sullivan et al.
2006/0196807 A1 9/2006 Rosenbaum et al.
2006/0199743 A1 9/2006 Rosenbaum et al.
2006/0201851 A1 9/2006 Rosenbaum et al.
2006/0201852 A1 9/2006 Rosenbaum et al.
2006/0205610 A1 9/2006 Rosenbaum et al.
2006/0223720 A1 10/2006 Sullivan et al.
2006/0237344 A1 10/2006 Abernathy et al.
2006/0270568 A1 11/2006 Kawata
2007/0000807 A1 1/2007 Wu et al.
2007/0027042 A1* 2/2007 Suzuki et al. ..... 508/421
2007/0078070 A1 4/2007 Shirazi et al.
2007/0238628 A1 10/2007 Haire et al.

* cited by examiner

GEAR OIL COMPOSITIONS, METHODS OF MAKING AND USING THEREOF

CROSS REFERENCE TO RELATED APPLICATIONS

This application is a continuation-in-part of U.S. patent application Ser. No. 11/845,905 filed Aug. 28, 2007, the disclosure of which is incorporated herein by reference.

TECHNICAL FIELD

The invention relates generally to compositions suitable for use as lubricants, more particularly for use as gear oils.

BACKGROUND

Gear oil is used in industrial applications as well moving equipment such as automobiles, tractors, and the like (collectively referred to as "equipment"). When in use in some applications, the gear oil is present as an oil film between the moving parts, e.g., traction drives. In traction drive applications, power is transmitted via the gear oil film. In some applications, e.g., a hypoid gear of final reduction gear, it is very desirable to form/retain a thick oil film between gears. Increased oil film thickness to a sufficient level can protect a friction surface from damages, greatly improving gear and/or bearing fatigue life and load resistance characteristics.

Traction coefficient is the force required to move a load, divided by the load. The coefficient number expresses the ease with which the lubricant film is sheared. It is desirable for gear oils to have a low traction coefficient as the lower the traction coefficient, the less energy is dissipated due to lubricant shearing.

Besides having a low traction coefficient, it is important for a gear oil to have a high pressure-viscosity coefficient. The pressure-viscosity coefficient ("PVC") refers to the relationship between the load placed on the oil film (pressure) at the dynamic load zone and the thickness of the oil film (viscosity) at that load, when all other factors (material, temperature, geometry, speed, load) are constant. The pressure-viscosity coefficient of a gear oil is a fixed value for an oil film thickness in a given set of conditions (elastohydrodynamic regime, also known as an EHL or EHD regime) based on a mathematical estimation as noted in the American Gear Manufacturers Association (AGMA) Information Sheet AGMA 925-A03. It is desirable for gear oils to have a high PVC value.

In a number of patent publications and applications, i.e., US 2006/0289337, US2006/0201851, US2006/0016721, US2006/0016724, US2006/0076267, US2006/020185, US2006/013210, US2005/0241990, US2005/0077208, US2005/0139513, US2005/0139514, US2005/0133409, US2005/0133407, US2005/0261147, US2005/0261146, US2005/0261145, US2004/0159582, U.S. Pat. No. 7,018,525, U.S. Pat. No. 7,083,713, U.S. application Ser. Nos. 11/400,570, 11/535,165 and 11/613,936, which are incorporated herein by reference, an alternative hydrocarbon product, i.e., a Fischer Tropsch base oil is produced from a process in which the feed is a waxy feed recovered from a Fischer-Tropsch synthesis. The process comprises a complete or partial hydroisomerization dewaxing step, using a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions.

The Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process. Details of these processes and others are described in, for example, EP-A-776959, EP-A-668342; U.S. Pat. Nos. 4,943,672, 5,059,299, 5,733,839, and RE39073; and US Published Application No. 2005/0227866, WO-A-9934917, WO-A-9920720 and WO-A-05107935. The Fischer-Tropsch synthesis product usually comprises hydrocarbons having 1 to 100, or even more than 100 carbon atoms, and typically includes paraffins, olefins and oxygenated products. Fischer Tropsch is a viable process to generate clean alternative hydrocarbon products.

There is a need for a gear oil composition containing alternative hydrocarbon products having a low traction coefficient, a high pressure-viscosity coefficient, and optimal film thickness properties.

SUMMARY OF THE INVENTION

In one aspect, the invention relates to a gear oil composition comprising: a) a base oil containing a synergistic mixture of at least an isomerized base oil having consecutive numbers of carbon atoms and less than 10 wt % naphthenic carbon by n-d-M, and a mineral oil having a kinematic viscosity of 3 to 120 $mm^2/s$ at 100° C. and a viscosity index of at least 60; b) 0.001 to 30 wt % at least an additive selected from traction reducers, dispersants, viscosity modifiers, pour point depressants, antifoaming agents, antioxidants, rust inhibitors, metal passivators, extreme pressure agents, friction modifiers, and mixtures thereof; wherein the isomerized base oil is present in a synergistic amount for the gear oil composition to have a traction coefficient at 15 $mm^2/s$. of less than 0.030.

In another aspect, the invention relates to a method for improving the traction coefficient property of a gear oil, the method comprises adding to a base oil typically used for preparing the gear oil a synergistic amount of at least an isomerized base oil for the gear oil to have a traction coefficient at 15 $mm^2/s$. of less than 0.030, wherein the isomerized base oil has consecutive numbers of carbon atoms and less than 10 wt % naphthenic carbon by n-d-M. In one embodiment, the sufficient amount of isomerized base oil to be added to the base oil matrix ranges from 20 to 80 wt. % based on the total weight of the gear oil composition.

DETAILED DESCRIPTION

Figure 1:
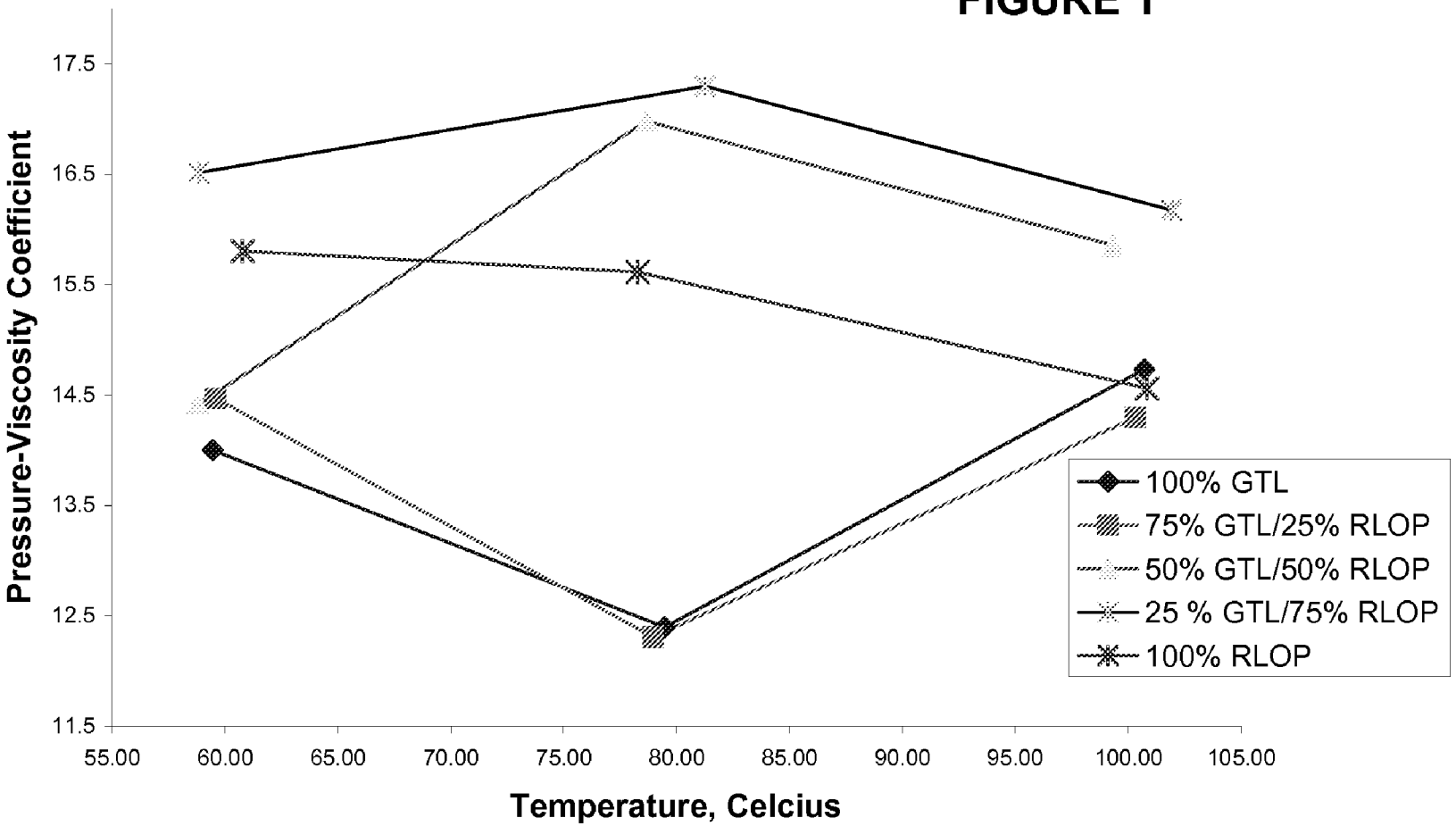
FIG. 1 is a graph comparing the film thickness of the gear compositions of Examples 1-5 at different temperatures.

The following terms will be used throughout the specification and will have the following meanings unless otherwise indicated.

"Fischer-Tropsch derived" means that the product, fraction, or feed originates from or is produced at some stage by a Fischer-Tropsch process. As used herein, "Fischer-Tropsch base oil" may be used interchangeably with "FT base oil," "FTBO," "GTL base oil" (GTL: gas-to-liquid), or "Fischer-Tropsch derived base oil."

As used herein, "isomerized base oil" refers to a base oil made by isomerization of a waxy feed.

As used herein, a "waxy feed" comprises at least 40 wt % n-paraffins. In one embodiment, the waxy feed comprises greater than 50 wt % n-paraffins. In another embodiment, greater than 75 wt % n-paraffins. In one embodiment, the waxy feed also has very low levels of nitrogen and sulphur, e.g., less than 25 ppm total combined nitrogen and sulfur, or in other embodiments less than 20 ppm. Examples of waxy feeds include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof. In one embodiment, the waxy feeds have a pour point of greater than 50° C. In another embodiment, greater than 60° C.

"Kinematic viscosity" is a measurement in $mm^2/s$ of the resistance to flow of a fluid under gravity, determined by ASTM D445-06.

"Viscosity index" (VI) is an empirical, unit-less number indicating the effect of temperature change on the kinematic viscosity of the oil. The higher the VI of an oil, the lower its tendency to change viscosity with temperature. Viscosity index is measured according to ASTM D 2270-04.

Cold-cranking simulator apparent viscosity (CCS VIS) is a measurement in millipascal seconds, mPa·s to measure the viscometric properties of lubricating base oils under low temperature and high shear. CCS VIS is determined by ASTM D 5293-04.

The boiling range distribution of base oil, by wt %, is determined by simulated distillation (SIMDIS) according to ASTM D 6352-04, "Boiling Range Distribution of Petroleum Distillates in Boiling Range from 174 to 700° C. by Gas Chromatography."

"Noack volatility" is defined as the mass of oil, expressed in weight %, which is lost when the oil is heated at 250° C. with a constant flow of air drawn through it for 60 min., measured according to ASTM D5800-05, Procedure B.

Brookfield viscosity is used to determine the internal fluid-friction of a lubricant during cold temperature operation, which can be measured by ASTM D 2983-04.

"Pour point" is a measurement of the temperature at which a sample of base oil will begin to flow under certain carefully controlled conditions, which can be determined as described in ASTM D 5950-02.

"Auto ignition temperature" is the temperature at which a fluid will ignite spontaneously in contact with air, which can be determined according to ASTM 659-78.

"Ln" refers to natural logarithm with base "e."

"Traction coefficient" is an indicator of intrinsic lubricant properties, expressed as the dimensionless ratio of the friction force F and the normal force N, where friction is the mechanical force which resists movement or hinders movement between sliding or rolling surfaces. Traction coefficient can be measured with an MTM Traction Measurement System from PCS Instruments, Ltd., configured with a polished 19 mm diameter ball (SAE AISI 52100 steel) angled at 220 to a flat 46 mm diameter polished disk (SAE AISI 52100 steel). The steel ball and disk are independently measured at an average rolling speed of 3 meters per second, a slide to roll ratio of 40 percent, and a load of 20 Newtons. The roll ratio is defined as the difference in sliding speed between the ball and disk divided by the mean speed of the ball and disk, i.e. roll ratio=(Speed1−Speed2)/((Speed1+Speed2)−/2).

As used herein, "consecutive numbers of carbon atoms" means that the base oil has a distribution of hydrocarbon molecules over a range of carbon numbers, with every number of carbon numbers in-between. For example, the base oil may have hydrocarbon molecules ranging from C22 to C36 or from C30 to C60 with every carbon number in-between. The hydrocarbon molecules of the base oil differ from each other by consecutive numbers of carbon atoms, as a consequence of the waxy feed also having consecutive numbers of carbon atoms. For example, in the Fischer-Tropsch hydrocarbon synthesis reaction, the source of carbon atoms is CO and the hydrocarbon molecules are built up one carbon atom at a time. Petroleum-derived waxy feeds have consecutive numbers of carbon atoms. In contrast to an oil based on poly-alpha-olefin ("PAO"), the molecules of an isomerized base oil have a more linear structure, comprising a relatively long backbone with short branches. The classic textbook description of a PAO is a star-shaped molecule, and in particular tridecane, which is illustrated as three decane molecules attached at a central point. While a star-shaped molecule is theoretical, nevertheless PAO molecules have fewer and longer branches that the hydrocarbon molecules that make up the isomerized base oil disclosed herein.

"Molecules with cycloparaffinic functionality" mean any molecule that is, or contains as one or more substituents, a monocyclic or a fused multicyclic saturated hydrocarbon group.

"Molecules with monocycloparaffinic functionality" mean any molecule that is a monocyclic saturated hydrocarbon group of three to seven ring carbons or any molecule that is substituted with a single monocyclic saturated hydrocarbon group of three to seven ring carbons.

"Molecules with multicycloparaffinic functionality" mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons.

Molecules with cycloparaffinic functionality, molecules with monocycloparaffinic functionality, and molecules with multicycloparaffinic functionality are reported as weight percent and are determined by a combination of Field Ionization Mass Spectroscopy (FIMS), HPLC-UV for aromatics, and Proton NMR for olefins, further fully described herein.

Oxidator BN measures the response of a lubricating oil in a simulated application. High values, or long times to adsorb one liter of oxygen, indicate good stability. Oxidator BN can be measured via a Dornte-type oxygen absorption apparatus (R. W. Dornte "Oxidation of White Oils," Industrial and Engineering Chemistry, Vol. 28, page 26, 1936), under 1 atmosphere of pure oxygen at 340° F., time to absorb 1000 ml of $O_2$ by 100 g. of oil is reported. In the Oxidator BN test, 0.8 ml of catalyst is used per 100 grams of oil. The catalyst is a mixture of soluble metal-naphthenates simulating the average metal analysis of used crankcase oil. The additive package is 80 millimoles of zinc bispolypropylenephenyldithiophosphate per 100 grams of oil.

Molecular characterizations can be performed by methods known in the art, including Field Ionization Mass Spectroscopy (FIMS) and n-d-M analysis (ASTM D 3238-95 (Reapproved 2005)). In FIMS, the base oil is characterized as alkanes and molecules with different numbers of unsaturations. The molecules with different numbers of unsaturations may be comprised of cycloparaffins, olefins, and aromatics. If aromatics are present in significant amount, they would be identified as 4-unsaturations. When olefins are present in significant amounts, they would be identified as 1-unsaturations. The total of the 1-unsaturations, 2-unsaturations, 3-unsaturations, 4-unsaturations, 5-unsaturations, and 6-unsaturations from the FIMS analysis, minus the wt % olefins by proton NMR, and minus the wt % aromatics by HPLC-UV is the total weight percent of molecules with cycloparaffinic functionality. If the aromatics content was not measured, it was assumed to be less than 0.1 wt % and not included in the calculation for total weight percent of molecules with cycloparaffinic functionality. The total weight percent of molecules with cycloparaffinic functionality is the sum of the weight percent of molecules with monocycloparaffinic functionality and the weight percent of molecules with multicycloparaffinic functionality.

Molecular weights are determined by ASTM D2503-92 (Reapproved 2002). The method uses thermoelectric measurement of vapour pressure (VPO). In circumstances where there is insufficient sample volume, an alternative method of ASTM D2502-04 may be used; and where this has been used it is indicated.

Density is determined by ASTM D4052-96 (Reapproved 2002). The sample is introduced into an oscillating sample tube and the change in oscillating frequency caused by the change in the mass of the tube is used in conjunction with calibration data to determine the density of the sample.

Weight percent olefins can be determined by proton-NMR according to the steps specified herein. In most tests, the olefins are conventional olefins, i.e. a distributed mixture of those olefin types having hydrogens attached to the double bond carbons such as: alpha, vinylidene, cis, trans, and tri-substituted, with a detectable allylic to olefin integral ratio between 1 and 2.5. When this ratio exceeds 3, it indicates a higher percentage of tri or tetra substituted olefins being present, thus other assumptions known in the analytical art can be made to calculate the number of double bonds in the sample. The steps are as follows: A) Prepare a solution of 5-10% of the test hydrocarbon in deuterochloroform. B) Acquire a normal proton spectrum of at least 12 ppm spectral width and accurately reference the chemical shift (ppm) axis, with the instrument having sufficient gain range to acquire a signal without overloading the receiver/ADC, e.g., when a 30 degree pulse is applied, the instrument having a minimum signal digitization dynamic range of 65,000. In one embodiment, the instrument has a dynamic range of at least 260,000. C) Measure the integral intensities between: 6.0-4.5 ppm (olefin); 2.2-1.9 ppm (allylic); and 1.9-0.5 ppm (saturate). D) Using the molecular weight of the test substance determined by ASTM D 2503-92 (Reapproved 2002), calculate: 1. The average molecular formula of the saturated hydrocarbons; 2. The average molecular formula of the olefins; 3. The total integral intensity (=sum of all integral intensities); 4. The integral intensity per sample hydrogen (=total integral/number of hydrogens in formula); 5. The number of olefin hydrogens (=olefin integral/integral per hydrogen); 6. The number of double bonds (=olefin hydrogen times hydrogens in olefin formula/2); and 7. The wt % olefins by proton NMR=100 times the number of double bonds times the number of hydrogens in a typical olefin molecule divided by the number of hydrogens in a typical test substance molecule. In this test, the wt % olefins by proton NMR calculation procedure, D, works particularly well when the percent olefins result is low, less than 15 wt %.

Weight percent aromatics in one embodiment can be measured by HPLC-UV. In one embodiment, the test is conducted using a Hewlett Packard 1050 Series Quaternary Gradient High Performance Liquid Chromatography (HPLC) system, coupled with a HP 1050 Diode-Array UV-Vis detector interfaced to an HP Chem-station. Identification of the individual aromatic classes in the highly saturated base oil can be made on the basis of the UV spectral pattern and the elution time. The amino column used for this analysis differentiates aromatic molecules largely on the basis of their ring-number (or double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution. Unequivocal identification of the various base oil aromatic hydrocarbons from their UV absorbance spectra can be accomplished recognizing that their peak electronic transitions are all red-shifted relative to the pure model compound analogs to a degree dependent on the amount of alkyl and naphthenic substitution on the ring system. Quantification of the eluting aromatic compounds can be made by integrating chromatograms made from wavelengths optimized for each general class of compounds over the appropriate retention time window for that aromatic. Retention time window limits for each aromatic class can be determined by manually evaluating the individual absorbance spectra of eluting compounds at different times and assigning them to the appropriate aromatic class based on their qualitative similarity to model compound absorption spectra.

HPLC-UV Calibration. In one embodiment, HPLC-UV can be used for identifying classes of aromatic compounds even at very low levels, e.g., multi-ring aromatics typically absorb 10 to 200 times more strongly than single-ring aromatics. Alkyl-substitution affects absorption by 20%. Integration limits for the co-eluting 1-ring and 2-ring aromatics at 272 nm can be made by the perpendicular drop method. Wavelength dependent response factors for each general aromatic class can be first determined by constructing Beer's Law plots from pure model compound mixtures based on the nearest spectral peak absorbances to the substituted aromatic analogs. Weight percent concentrations of aromatics can be calculated by assuming that the average molecular weight for each aromatic class was approximately equal to the average molecular weight for the whole base oil sample.

NMR analysis. In one embodiment, the weight percent of all molecules with at least one aromatic function in the purified mono-aromatic standard can be confirmed via long-duration carbon 13 NMR analysis. The NMR results can be translated from % aromatic carbon to % aromatic molecules (to be consistent with HPLC-UV and D 2007) knowing that 95-99% of the aromatics in highly saturated base oils are single-ring aromatics. In another test to accurately measure low levels of all molecules with at least one aromatic function by NMR, the standard D 5292-99 (Reapproved 2004) method can be modified to give a minimum carbon sensitivity of 500:1 (by ASTM standard practice E 386) with a 15-hour duration run on a 400-500 MHz NMR with a 10-12 mm Nalorac probe. Acorn PC integration software can be used to define the shape of the baseline and consistently integrate.

Extent of branching refers to the number of alkyl branches in hydrocarbons. Branching and branching position can be determined using carbon-13 ($^{13}C$) NMR according to the following nine-step process: 1) Identify the CH branch centers and the $CH_3$ branch termination points using the DEPT Pulse sequence (Doddrell, D. T.; D. T. Pegg; M. R. Bendall, *Journal of Magnetic Resonance* 1982, 48, 323ff.). 2) Verify the absence of carbons initiating multiple branches (quaternary carbons) using the APT pulse sequence (Patt, S. L.; J. N. Shoolery, *Journal of Magnetic Resonance* 1982, 46, 535ff.). 3) Assign the various branch carbon resonances to specific branch positions and lengths using tabulated and calculated values known in the art (Lindeman, L. P., *Journal of Qualitative Analytical Chemistry* 43, 1971 1245ff; Netzel, D. A., et. al., *Fuel,* 60, 1981, 307ff). 4) Estimate relative branching density at different carbon positions by comparing the integrated intensity of the specific carbon of the methyl/alkyl group to the intensity of a single carbon (which is equal to total integral/number of carbons per molecule in the mixture). For the 2-methyl branch, where both the terminal and the branch methyl occur at the same resonance position, the intensity is divided by two before estimating the branching density. If the 4–methyl branch fraction is calculated and tabulated, its contribution to the 4+methyls is subtracted to avoid double counting. 5) Calculate the average carbon number. The average carbon number is determined by dividing the molecular weight of the sample by 14 (the formula weight of $CH_2$). 6) The number of branches per molecule is the sum of the branches found in step 4. 7) The number of alkyl branches per 100 carbon atoms is calculated from the number of branches per molecule (step 6) times 100/average carbon number. 8) Estimate Branching Index (BI) by $^1$H NMR Analysis, which is presented as percentage of methyl hydrogen (chemical shift range 0.6-1.05 ppm) among total hydrogen as estimated by NMR in the liquid hydrocarbon composition. 9) Estimate Branching proximity (BP) by $^{13}$C NMR, which is presented as percentage of recurring methylene carbons—which are four or more carbons away from the end group or a branch (represented by a NMR signal at 29.9 ppm) among total carbons as estimated by NMR in the liquid hydrocarbon composition. The measurements can be performed using any Fourier Transform NMR spectrometer, e.g., one having a magnet of 7.0 T or greater. After verification by Mass Spectrometry, UV or an NMR survey that aromatic carbons are absent, the spectral width for the $^{13}$C NMR studies can be limited to the saturated carbon region, 0-80 ppm vs. TMS (tetramethylsilane). Solutions of 25-50 wt. % in chloroform-dl are excited by 30 degrees pulses followed by a 1.3 seconds (sec.) acquisition time. In order to minimize non-uniform intensity data, the broadband proton inverse-gated decoupling is used during a 6 sec. delay prior to the excitation pulse and on during acquisition. Samples are doped with 0.03 to 0.05 M Cr (acac)$_3$(tris(acetylacetonato)-chromium (III)) as a relaxation agent to ensure full intensities are observed. The DEPT and APT sequences can be carried out according to literature descriptions with minor deviations described in the Varian or Bruker operating manuals. DEPT is Distortionless Enhancement by Polarization Transfer. The DEPT 45 sequence gives a signal all carbons bonded to protons. DEPT 90 shows CH carbons only. DEPT 135 shows CH and $CH_3$ up and $CH_2$ 180 degrees out of phase (down). APT is attached proton test, known in the art. It allows all carbons to be seen, but if CH and $CH_3$ are up, then quaternaries and $CH_2$ are down. The branching properties of the sample can be determined by $^{13}$C NMR using the assumption in the calculations that the entire sample was iso-paraffinic. The unsaturates content may be measured using Field Ionization Mass Spectroscopy (FIMS).

The gear oil composition comprises 0.001 to 30 wt. % of optional additives in a base oil matrix having a synergistic blend of two components, an isomerized base oil component and a mineral oil component, with the amount of the isomerized base oil being sufficient for the gear oil composition to have the desired traction coefficient, film thickness, and pressure-viscosity coefficient properties.

Component A—Isomerized Base Oil: In one embodiment, component A of the base oil matrix comprises at least an isomerized base oil (or blends of isomerized base oils) which the product itself, its fraction, or feed originates from or is produced at some stage by isomerization of a waxy feed from a Fischer-Tropsch process ("Fischer-Tropsch derived base oils"). In another embodiment, the base oil comprises at least an isomerized base oil made from a substantially paraffinic wax feed ("waxy feed"). In yet another embodiment, the isomerized base oil comprises mixtures of products made from a substantially paraffinic wax feed as well as products made from a waxy feed from a Fischer-Tropsch process.

Fischer-Tropsch derived base oils are disclosed in a number of patent publications, including for example U.S. Pat. Nos. 6,080,301, 6,090,989, and 6,165,949, and US Patent Publication No. US2004/0079678A1, US20050133409, US20060289337. The Fischer-Tropsch process is a catalyzed chemical reaction in which carbon monoxide and hydrogen are converted into liquid hydrocarbons of various forms including a light reaction product and a waxy reaction product, with both being substantially paraffinic.

In one embodiment, component A comprises an isomerized base oil having consecutive numbers of carbon atoms and has less than 10 wt % naphthenic carbon by n-d-M. In yet another embodiment the isomerized base oil made from a waxy feed has a kinematic viscosity at 100° C. between 1.5 and 3.5 mm$^2$/s.

In one embodiment, the isomerized base oil is made by a process in which the hydroisomerization dewaxing is performed at conditions sufficient for the base oil to have: a) a weight percent of all molecules with at least one aromatic functionality less than 0.30; b) a weight percent of all molecules with at least one cycloparaffinic functionality greater than 10; c) a ratio of weight percent molecules with monocycloparaffinic functionality to weight percent molecules with multicycloparaffinic functionality greater than 20 and d) a viscosity index greater than 28×Ln (Kinematic viscosity at 100° C.)+80.

In another embodiment, the isomerized base oil is made from a process in which the highly paraffinic wax is hydroisomerized using a shape selective intermediate pore size molecular sieve comprising a noble metal hydrogenation component, and under conditions of 600-750° F. (315-399° C.) In the process, the conditions for hydroisomerization are controlled such that the conversion of the compounds boiling above 700° F. (371° C.) in the wax feed to compounds boiling below 700° F. (371° C.) is maintained between 10 wt % and 50 wt %. A resulting isomerized base oil has a kinematic viscosity of between 1.0 and 3.5 mm$^2$/s at 100° C. and a Noack volatility of less than 50 weight %. The base oil comprises greater than 3 weight % molecules with cycloparaffinic functionality and less than 0.30 weight percent aromatics.

In one embodiment the isomerized base oil in component A has a Noack volatility less than an amount calculated by the following equation: 1000×(Kinematic Viscosity at 100° C.)$^{-2.7}$. In another embodiment, the isomerized base oil has a Noack volatility less than an amount calculated by the following equation: 900×(Kinematic Viscosity at 100° C.)$^{-2.8}$. In a third embodiment, the isomerized base oil has a Kinematic Viscosity at 100° C. of >1.808 mm$^2$/s and a Noack volatility less than an amount calculated by the following equation: $1.286+20\,(kv100)^{-1.5}+551.8\,e^{-kv100}$, where kv100 is the kinematic viscosity at 100° C. In a fourth embodiment, the isomerized base oil has a kinematic viscosity at 100° C. of less than 4.0 mm$^2$/s, and a wt % Noack volatility between 0 and 100. In a fifth embodiment, the isomerized base oil has a kinematic viscosity between 1.5 and 4.0 mm$^2$/s and a Noack volatility less than the Noack volatility calculated by the following equation: 160-40 (Kinematic Viscosity at 100° C.).

In one embodiment, the isomerized base oil has a kinematic viscosity at 100° C. in the range of 2.4 and 3.8 mm$^2$/s and a Noack volatility less than an amount defined by the equation: 900×(Kinematic Viscosity at 100° C.)$^{-2.8}$−15). For kinematic viscosities in the range of 2.4 and 3.8 mm$^2$/s, the equation: 900×(Kinematic Viscosity at 100° C.)$^{-2.8}$−15) provides a lower Noack volatility than the equation: 160-40 (Kinematic Viscosity at 100° C.)

In one embodiment, the isomerized base oil in component A is made from a process in which the highly paraffinic wax is hydroisomerized under conditions for the base oil to have a kinematic viscosity at 100° C. of 3.6 to 4.2 $mm^2/s$, a viscosity index of greater than 130, a wt % Noack volatility less than 12, a pour point of less than −9° C.

In one embodiment, the isomerized base oil has an aniline point, in degrees F, greater than 200 and less than or equal to an amount defined by the equation: 36×Ln(Kinematic Viscosity at 100° C., in $mm^2/s$)+200.

In one embodiment, the isomerized base oil has an autoignition temperature (AIT) greater than the AIT defined by the equation: AIT in ° C.=1.6×(Kinematic Viscosity at 40° C., in mm2/s)+300. In a second embodiment, the base oil as an AIT of greater than 329° C. and a viscosity index greater than 28×Ln (Kinematic Viscosity at 100° C., in $mm^2/s$)+100.

In one embodiment, the isomerized base oil has a relatively low traction coefficient, specifically, its traction coefficient is less than an amount calculated by the equation: traction coefficient=0.009×Ln (kinematic viscosity in $mm^2/s$)−0.001, wherein the kinematic viscosity in the equation is the kinematic viscosity during the traction coefficient measurement and is between 2 and 50 $mm^2/s$. In one embodiment, the isomerized base oil has a traction coefficient of less than 0.023 (or less than 0.021) when measured at a kinematic viscosity of 15 $mm^2/s$ and at a slide to roll ratio of 40%. In another embodiment the isomerized base oil has a traction coefficient of less than 0.017 when measured at a kinematic viscosity of 15 $mm^2/s$ and at a slide to roll ratio of 40%. In another embodiment the isomerized base oil has a viscosity index greater than 150 and a traction coefficient less than 0.015 when measured at a kinematic viscosity of 15 $mm^2/s$ and at a slide to roll ratio of 40 percent.

In some embodiments, component A comprises an isomerized base oil having low traction coefficient as well as a higher kinematic viscosity and higher boiling points. In one embodiment, the base oil has a traction coefficient less than 0.015, and a 50 wt % boiling point greater than 565° C. (1050° F.). In another embodiment, the base oil has a traction coefficient less than 0.011 and a 50 wt % boiling point by ASTM D 6352-04 greater than 582° C. (1080° F.).

In some embodiments, the isomerized base oil having low traction coefficients also displays unique branching properties by NMR, including a branching index less than or equal to 23.4, a branching proximity greater than or equal to 22.0, and a Free Carbon Index between 9 and 30. In one embodiment, the base oil has at least 4 wt % naphthenic carbon, in another embodiment, at least 5 wt % naphthenic carbon by n-d-M analysis by ASTM D 3238-95 (Reapproved 2005).

In one embodiment, the isomerized base oil in component A is produced in a process wherein the intermediate oil isomerate comprises paraffinic hydrocarbon components, and in which the extent of branching is less than 7 alkyl branches per 100 carbons, and wherein the base oil comprises paraffinic hydrocarbon components in which the extent of branching is less than 8 alkyl branches per 100 carbons and less than 20 wt % of the alkyl branches are at the 2 position. In one embodiment, the FT base oil has a pour point of less than −8° C.; a kinematic viscosity at 100° C. of at least 3.2 $mm^2/s$; and a viscosity index greater than a viscosity index calculated by the equation of =22×Ln (kinematic viscosity at 100° C.)+132.

In one embodiment, the base oil comprises greater than 10 wt. % and less than 70 wt. % total molecules with cycloparaffinic functionality, and a ratio of weight percent molecules with monocycloparaffinic functionality to weight percent molecules with multicycloparaffinic functionality greater than 15.

In one embodiment, component A has an average molecular weight between 600 and 1100, and an average degree of branching in the molecules between 6.5 and 10 alkyl branches per 100 carbon atoms. In another embodiment, the isomerized base oil has a kinematic viscosity between about 8 and about 25 $mm^2/s$ and an average degree of branching in the molecules between 6.5 and 10 alkyl branches per 100 carbon atoms.

In one embodiment, the isomerized base oil is obtained from a process in which the highly paraffinic wax is hydroisomerized at a hydrogen to feed ratio from 712.4 to 3562 liter $H_2$/liter oil, for the base oil to have a total weight percent of molecules with cycloparaffinic functionality of greater than 10, and a ratio of weight percent molecules with monocycloparaffinic functionality to weight percent molecules with multicycloparaffinic functionality of greater than 15. In another embodiment, the base oil has a viscosity index greater than an amount defined by the equation: 28×Ln (Kinematic viscosity at 100° C.)+95. In a third embodiment, the base oil comprises a weight percent aromatics less than 0.30; a weight percent of molecules with cycloparaffinic functionality greater than 10; a ratio of weight percent of molecules with monocycloparaffinic functionality to weight percent of molecules with multicycloparaffinic functionality greater than 20; and a viscosity index greater than 28×Ln (Kinematic Viscosity at 100° C.)+110. In a fourth embodiment, the base oil further has a kinematic viscosity at 100° C. greater than 6 $mm^2/s$. In a fifth embodiment, the base oil has a weight percent aromatics less than 0.05 and a viscosity index greater than 28×Ln (Kinematic Viscosity at 100° C.)+95. In a sixth embodiment, the base oil has a weight percent aromatics less than 0.30, a weight percent molecules with cycloparaffinic functionality greater than the kinematic viscosity at 100° C., in $mm^2/s$, multiplied by three, and a ratio of molecules with monocycloparaffinic functionality to molecules with multicycloparaffinic functionality greater than 15.

In one embodiment, the isomerized base oil contains between 2 and 10% naphthenic carbon as measured by n-d-M. In one embodiment, the base oil has a kinematic viscosity of 1.5-3.0 $mm^2/s$ at 100° C. and 2-3% naphthenic carbon. In another embodiment, a kinematic viscosity of 1.8-3.5 $mm^2/s$ at 100° C. and 2.5-4% naphthenic carbon. In a third embodiment, a kinematic viscosity of 3-6 $mm^2/s$ at 100° C. and 2.7-5% naphthenic carbon. In a fourth embodiment, a kinematic viscosity of 10-30 $mm^2/s$ at 100° C. and greater than 5.2% naphthenic carbon.

In one embodiment, component A is an isomerized base oil having an average molecular weight greater than 475; a viscosity index greater than 140, and a weight percent olefins less than 10. The base oil improves the air release and low foaming characteristics of the mixture when incorporated into the gear oil composition.

In one embodiment, component A comprises a white oil as disclosed in U.S. Pat. No. 7,214,307 and US Patent Publication US20060016724. In one embodiment, the isomerized base oil is a white oil having a kinematic viscosity between about 1.5 cSt and 36 $mm^2/s$ at 100° C., a viscosity index greater than an amount calculated by the equation: Viscosity Index=28×Ln(the Kinematic Viscosity at 100° C.)+95, between 5 and less than 18 weight percent molecules with cycloparaffinic functionality, less than 1.2 weight percent molecules with multicycloparaffinic functionality, a pour point less than 0° C. and a Saybolt color of +20 or greater.

In one embodiment, the isomerized base oil for use in component A has a kinematic viscosity @40° C. ranging from 80 to 110 $mm^2/s$., a kinematic viscosity @100° C. ranging from 10 to 16 $mm^2/s$., a viscosity index of 140-160, a pour point in the range of −0° C. to −40° C., an average molecular weight of 650-725, and a sulfur content of less than 1 ppm.

Component B—Mineral Oil: Component B is a mineral oil or mixtures of mineral oils. The mineral oil can be any of paraffinic and naphthenic oils, or mixtures thereof. Mineral oils can be obtained by subjecting a lubricating oil fraction produced by atmospheric- or vacuum-distilling a crude oil, to one or more refining processes such as solvent deasphalting, solvent extraction, hydrocracking, solvent dewaxing, catalytic dewaxing, hydrorefining, sulfuric acid treating, and clay treatment.

In one embodiment, the mineral oil used as Component B may contain an amount of synthetic oils such as poly-α-olefins, ethylene-α-olefins copolymer, and ester-based synthetic oils, in an amount of 50 wt. % or less of the total weight of the gear oil composition.

In one embodiment, Component B is a mineral oil (or blends of mineral oils and/or hydrocarbon-based synthetic oils) having a kinematic viscosity of 3 to 120 $mm^2/s$ at 100° C. and a viscosity index of at least 60. In another embodiment, Component B is a mineral oil having a kinematic viscosity of 2.3 to 3.4 $mm^2/s$ at 100° C. and a % Cp defined by ASTM D 3238 (R2000) is 70 or higher, ASTM D 3238 is a standard test method for calculation of Carbon distribution and structural group analysis of petroleum oils by the ndM method. In yet another embodiment, Component B is a base oil matrix having a kinematic viscosity of less than 80 $mm^2/s$ at 40° C., comprising a mixture of: a "low viscosity" mineral or and/or a synthetic oil having and a kinematic viscosity of 3.5 to 7 $mm^2/s$ at 100° C.; and a "high viscosity" mineral-based oil and/or hydrocarbon-based synthetic oil having a kinematic viscosity of 20 to 52 $mm^2/s$ at 100° C.

In one embodiment, the base oil matrix contains sufficient amounts of mineral and isomerized base oils for the base oil matrix to have a kinematic viscosity at 100° C. between 10 $mm^2/s$ and 15 $mm^2/s$; a kinematic viscosity at 40° C. between 95 mm2/s and 110 $mm^2/s$; and a viscosity index between 95 and 175.

Additional Optional Components: The incorporation of the isomerized base oil into the gear oil composition allows the composition to have a low traction coefficient without the need for traction reducers in the prior art. However, in one embodiment, small amounts of traction reducers, e.g., from 0.5 to 10 wt. %, can be incorporated in the gear oil composition. Examples of traction reducers include ExxonMobil's Norpar™ fluids (comprising normal paraffins), Isopar™ fluids (comprising isoparaffins), Exxsol™ fluids (comprising dearomatized hydrocarbon fluids), Varsol™ fluids (comprising aliphatic hydrocarbon fluids), and mixtures thereof.

In one embodiment, the gear oil composition comprises 0.01 to 30 wt. % of one or more additives selected from dispersants, viscosity index improvers, pour point depressants, antifoaming agents, antioxidants, rust inhibitors, metal passivators, extreme pressure agents, friction modifiers, etc., in order to satisfy diversified characteristics, e.g., those related to friction, oxidation stability, cleanness and defoaming, etc.

Examples of dispersants include those based on polybutenyl succinic acid imide, polybutenyl succinic acid amide, benzylamine, succinic acid ester, succinic acid ester-amide and a boron derivative thereof. When used, ashless dispersants are typically employed in an amount of 0.05 to 7 wt. %. In one embodiment, the dispersant are selected from the products of reaction of a polyethylene polyamine, e.g. triethylene tetraamine pentaamine, with a hydrocarbon-substituted anhydride made by the reaction of a polyolefin, having a molecular weight of about 700-1400 with an unsaturated polycarboxylic acid or anhydride, e.g. maleic anhydride.

Examples of metallic detergent include those containing a sulfonate, phenate, salicylate of calcium, magnesium, barium or the like. Metallic detergents when used, are typically incorporated in an amount of 0.05 to 5 wt. %.

Examples of antioxidants include but are not limited to amine-based ones, e.g., alkylated diphenylamine, phenyl-α-naphtylamine and alkylated phenyl-x-naphtylamine; phenol-based ones, e.g., 2,6-di-t-butyl phenol, 4,4'-methylenebis-(2,6-di-t-butyl phenol) and isooctyl-3-(3,5-di-t-butyl-4-hydroxyphenyl)propionate; sulfur-based ones, e.g., dilauryl-3,3'-thiodipropionate; and zinc dithiophosphate. When used, antioxidants are incorporated in an amount from 0.05 to 5 wt. %.

Defoaming agents can be optionally incorporated in an amount of 10-100 ppm. Examples of defoaming agents include but are not limited to dimethyl polysiloxane, polyacrylate and a fluorine derivative thereof, and poerfluoropolyether. Rust inhibitors can be used in an amount from 0 to 30 wt. %. Examples include a fatty acid, alkenylsuccinic acid half ester, fatty acid soap, alkylsulfonate, polyhydric alcohol/fatty acid ester, fatty acid amine, oxidized paraffin and alkylpolyoxyethylene ether.

Friction modifiers can be incorporated in an amount from 0.05 to 5 wt. %. Examples include but are not limited to organomolybdenum-based compounds, fatty acids, higher alcohols, fatty acid esters, sulfided esters, phosphoric acid ester, acid phosphoric acid esters, acid phosphorous acid esters and amine salt of phosphoric acid ester.

Anti-wear and/or extreme pressure agents can be incorporated in an amount from 0.1 to 10 wt. %. Examples of anti-wear and/or extreme pressure agents include metal-free sulfur containing species including sulfurized olefins, dialkyl polysulfides, diarylpolysulfides, sulfurized fats and oils, sulfurized fatty acid esters, trithiones, sulfurized oligomers of C2-C8 monoolefins, thiophosphoric acid compounds, sulfurized terpenes, thiocarbamate compounds, thiocarbonate compounds, sulfoxides, thiol sulfinates, and the like. Other examples include metal-free phosphorus—containing anti-wear and/or extreme pressure additives such as esters of phosphorus acids, amine salts of phosphorus acids and phosphorus acid-esters, and partial and total thio analogs of the foregoing. In one embodiment, the composition comprises an acid phosphate as an anti-wear agent, with the agent having the formula $R_1O(R_2O)P(O)OH$, where $R_1$ is hydrogen or hydrocarbyl and $R_2$ is hydrocarbyl.

Pour point depressant can be incorporated in an amount ranging from 0.05 to 10 wt. %. Examples include but are not limited to ethylene/vinyl acetate copolymer, condensate of chlorinated paraffin and naphthalene, condensate of chlorinated paraffin and phenol, polymethacrylate, polyalkyl styrene, chlorinated wax-naphthalene condensate, vinyl acetate-fumarate ester copolymer, and the like.

In one embodiment, the composition further comprises at least one of a polyoxyalkylene glycol, polyoxyalkylene glycol ether, and an ester as a solubilizing agent in an amount from 10 to 25 wt. %. Examples include esters of a dibasic acid (e.g., phthalic, succinic, alkylsuccinic, alkenylsuccinic, maleic, azelaic, suberic, sebacic, fumaric or adipic acid, or linolic acid dimmer) and alcohol (e.g., butyl, hexyl, 2-ethylhexyl, dodecyl alcohol, ethylene glycol, diethylene glycol monoether or propylene glycol); and esters of a monocarboxylic acid of 5 to 18 carbon atoms and polyol (e.g., neopentyl glycol, trimethylolpropane, pentaerythritol, dipentaerythritol or tripentaerythritol); polyoxyalkylene glycol ester; and phosphate ester.

In one embodiment, the composition further comprises at least a metal passivator, and sometimes specifically a copper passivator. Examples include thiazoles, triazoles, and thiadizoles. Specific examples of the thiazoles and thiadiazoles include 2-mercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis-(hydrocarbylthio)-1,3,4-thiadiazoles, and 2,5-bis-(hydrocarbyldithio)-1,3,4-thiadiazoles. Other suitable inhibitors of copper corrosion include imidazolines, described above, and the like.

In one embodiment, the composition further comprises at least a viscosity modifier in an amount of 0.50 to 10 wt. %. Examples of viscosity modifiers include but are not limited to the group of polymethacrylate type polymers, ethylene-propylene copolymers, styrene-isoprene copolymers, hydrated styrene-isoprene copolymers, polyisobutylene, and mixtures thereof. In one embodiment, the viscosity modifier is a blend of a polymethacrylate having a weight average molecular weight of 25,000 to 150,000 and a shear stability index less than 5 and a polymethacrylate having a weight average molecular weight of 500,000 to 1,000,000 and a shear stability index of 25 to 60.

The gear oil composition of the invention is characterized has having a synergistic amount of isomerized base oil for the composition to have a low traction coefficient, a high pressure-viscosity coefficient, and optimal film thickness properties. In one embodiment, this synergistic amount of isomerized base oil ranges from 20 to 75 wt. % (based on the total weight of the gear oil composition). In a second embodiment, the synergistic amount of isomerized base oil ranges from 25 to 65 wt. %. In a third embodiment, the synergistic amount of isomerized base oil ranges from 25-60 wt. %. In a fourth embodiment, the synergistic amount of isomerized base oil is at least 50 wt. %. In a fifth embodiment, the synergistic amount of isomerized base oil ranges from 50 to 65 wt. %.

In one embodiment, the gear oil comprises a blend of 25 to 70 wt. % (based on the total weight of the gear oil composition) of an isomerized base oil having a kinematic viscosity at 40° C. of 70-120 $mm^2/s$., a kinematic viscosity at 100° C. of 12 to 16 $mm^2/s$., and a viscosity index of 150-160; and 25-75 wt. % of a group II neutral base oil having a kinematic viscosity at 40° C. of 40-120 $mm^2/s$., a kinematic viscosity at 100° C. of 10 to 14 $mm^2/s$., and a viscosity index of 80-120.

Properties: In one embodiment, the gear oil composition having a synergistic combination of mineral and isomerized base oils has a traction coefficient at 15 $mm^2/s$. of less than 0.030, a pressure viscosity coefficient of greater than 15.0 $GPa^{-1}$ at 80° C., 20 Newton load, and 1.1 m/s rolling speed, and a film thickness of greater than 175 nm at 80° C. In another embodiment, the gear oil composition has a film thickness of at least 160 nm at 90° C. or 130 nm at 100° C. In a third embodiment, the gear oil composition has a pressure viscosity coefficient of at least 15.5 $GPa^{-1}$ at a temperature in the range of 70-100° C., 20 Newton load, and 1.1 m/s rolling speed. In a fourth embodiment, the gear oil composition has a traction coefficient at 15 $mm^2/s$. of less than 0.030.

In one embodiment for use as an automotive gear oil, the composition meets SAE J306 specifications for the designated viscosity grades. For example, under the specifications of SAE J-306, the measured viscosity at 100° C. (212° F.) of an SAE 90 gear oil must exceed 13.5 cSt after 20 hours of testing.

In yet another embodiment, the composition meets at least one of industry specifications SAE J2360, API GL-5 and API MT-1, and military specification MIL-PRF-2105E quality level.

Method for Making: Additives used in formulating the gear oil composition can be blended into base oil blends individually or in various sub-combinations. In one embodiment, all of the components are blended concurrently using an additive concentrate (i.e., additives plus a diluent, such as a hydrocarbon solvent). The use of an additive concentrate takes advantage of the mutual compatibility afforded by the combination of ingredients when in the form of an additive concentrate.

In another embodiment, the composition is prepared by mixing the base oil and the additive(s) at an appropriate temperature, e.g., 60° C., until homogeneous.

Applications: The composition is useful in any system that include elements or parts containing gears of any kind and rolling element bearings. In one embodiment, the composition is used as a gear oil for lubricating industrial gears, e.g., spur and bevel, helical and spiral bevel, hypoid, worm, and the like. In another embodiment, the composition is used in automotive/mobile equipment applications and parts, including aircraft propulsion systems, aircraft transmissions, wind turbine gears, automotive drive trains, transmissions, transfer cases, and differentials in automobiles, trucks, and other machinery. In yet another embodiment, the composition is used in wind turbines, plastic extruder gear boxes, and highly loaded gearboxes used in electricity generating systems, or paper, steel, oil, textile, lumber, cement industries, and the like.

EXAMPLES

The following Examples are given as non-limitative illustrations of aspects of the invention. Unless specified otherwise, the components in the examples are as follows (and expressed in wt. % in Table 1):

GTL is a Fischer-Tropsch derived base oil from Chevron Corporation of San Ramon, Calif. The properties of the FTBO base oil used are shown in Table 2.

RLOP is Chevron™ 600R group II heavy neutral oil from Chevron Corporation.

Additive X is an industrial gear sulfurphosphorus containing extreme pressure additive commercially available from various sources.

The kinematic viscosity, refractive index, and density are properties of the base oil matrix blends, measured using methods known in the art. The traction coefficients of the gear oils in the Examples are measured/calculated using methods and devices known in the art, e.g., a traction coefficient measurement device disclosed in U.S. Pat. No. 6,691,551, or a Twin-Disc machine designed by Santotrac, for measuring in the elastohydrodynamic (EHD) regime under high pressure of at least 300,000 psi.

The EHL film thickness is calculated using methods known in the art, e.g., the American Gear Manufacturers Association (AGMA) Information Sheet AGMA 925 equation 65, wherein the EHL film thickness is established by the operating temperature of the components. An oil film thickness is determined by the oil's response to the shape, temperature and velocity of the surfaces at the contact inlet. The thickness depends strongly on entraining velocity and oil viscosity. The pressure-viscosity coefficient ("PVC") quantifies the EHL film-generating capability of a gear oil, which can be measured by known methods. The PVC can be measured either directly by assessing viscosity as a function of pressure using high-pressure apparatus, or indirectly by measuring film thickness in an optical interferometer. PVC is the slope of the graphs plotting the log of viscosity vs. pressure.

Results of the experiments establish that the addition of the isomerized base oil helps improve the traction coefficient of the gear oil composition, lowering the traction coefficient of at least 10% to less than 0.030 at 15° C., with the values of 0.028 or below for compositions containing 25 to 75 wt. % isomerized base oil. The data establishes that the incorporation of a sufficient amount of isomerized base oil into a base oil matrix of gear oil compositions in the prior art, e.g., a base oil matrix containing mineral oil(s), provides a gear oil composition having desired optimal properties of low traction coefficient (e.g., less than 0.030) and high pressure viscosity coefficients or PVC (e.g., greater than 15.0 at a temperature of 70° C.).

Figure 2:
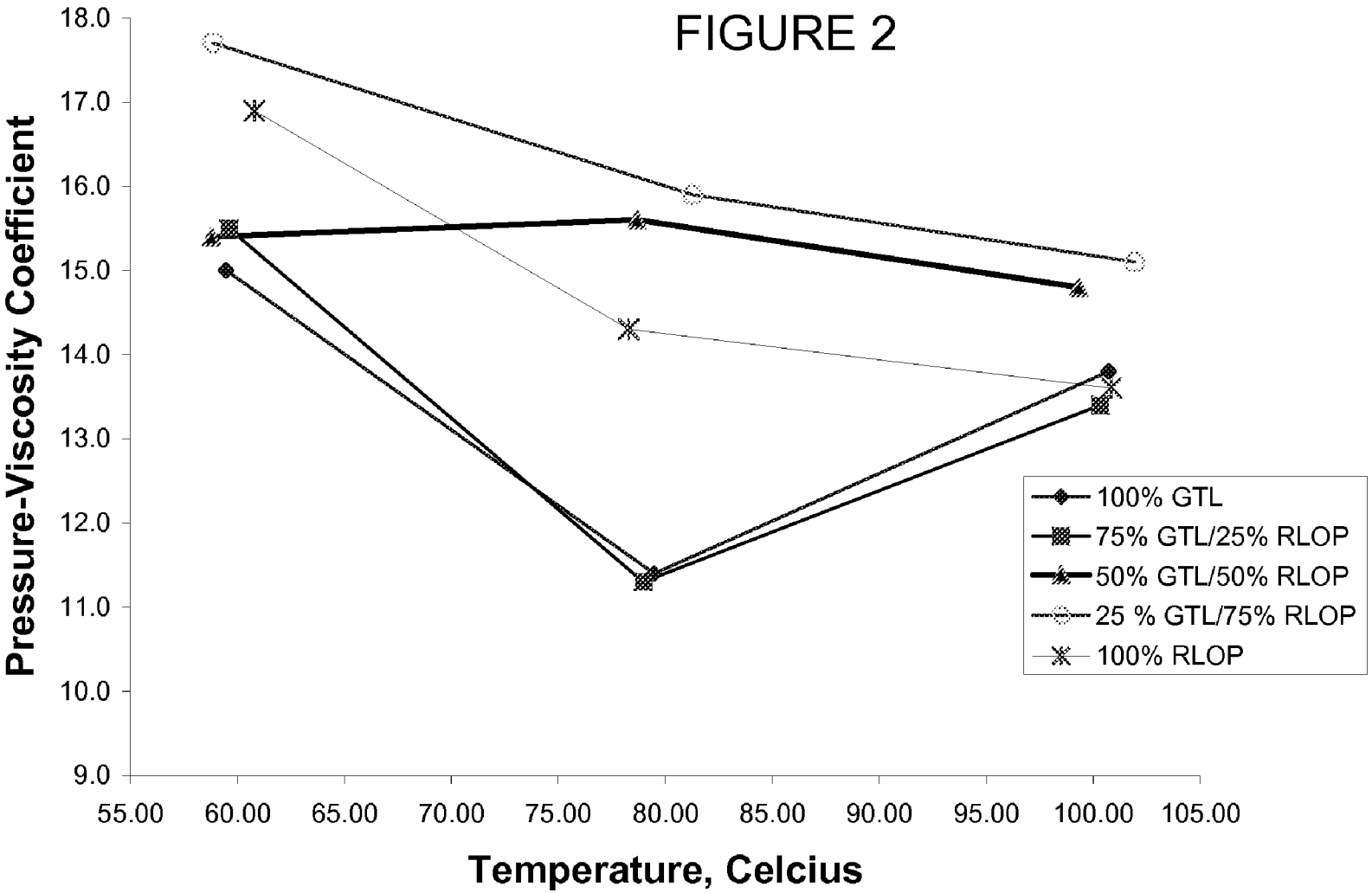
FIG. 2 is a graph comparing the pressure-viscosity coefficients of the gear compositions of Examples 1-5 at different temperatures.

FIGS. 1 and 2 are graphs comparing the film thicknesses (refractive index corrected) and the pressure-viscosity coefficients of the gear oil examples as a function of temperature. FIG. 2 shows that a gear oil composition consisting essentially of a Group II neutral oil in the prior art shows a relatively moderate PVC profile that exhibits a downward trend toward 14.0 $GPa^{-1}$ or less at 100° C. A gear oil composition consisting essentially of isomerized base oil exhibits lower PVC values than the group GTL-based oil in the range of 60-100° C.; its PVC value is less than 14.0 $GPa^{-1}$ throughout most of the 60-100° C. range, with a PVC value of 11.4 $GPa^{-1}$ at 80° C. Combining the isomerized base oil and a small amount of prior art base oil (e.g. 75% GTL and 25% RLOP 600R) affords only a marginal change in its PVC values relative to the GTL-based gear oil. However, compositions with higher amounts of prior art base oil exhibit significantly improved PVC values in the 60-100° C. range, with a value of 15.9 $GPa^{-1}$ at about 80° C. As shown in the Figure, these compositions show excellent synergy with the PVC values measured at 80° C. and 100° C. being greater than the corresponding values of either the isomerized base oil-only or RLOP-only gear oils. Even greater synergism is observed for a composition containing a Group II neutral oil base oil and a small amount of isomerized base oil (i.e. 25% GTL and 75% RLOP 600R), which composition exhibited synergistically enhanced PVC values throughout the 60-100° C. range.

TABLE 1

| | Example 1 | Example 2 | Example 3 | Example 4 | Example 5 |
|---|---|---|---|---|---|
| GTL-Fischer-Tropsch derived | 98.25 | 73.6875 | 49.125 | 24.5625 | — |
| RLOP Chevron ™ 600R group II | — | 24.5625 | 49.125 | 73.6875 | 98.25 |
| Additive X | 1.75 | 1.75 | 1.75 | 1.75 | 1.75 |
| Traction coefficient @ 15° C. | 0.016 | 0.018 | 0.021 | 0.028 | 0.033 |
| Kinematic viscosity @ 40° C., $mm^2/s$ | 99.38 | 99.8 | 100.8 | 103.2 | 107 |
| Kinematic viscosity @ 100° C., $mm^2/s$ | 14.79 | 14.07 | 13.37 | 12.7 | 11.84 |
| Viscosity Index | 155 | 144 | 131 | 117 | 99 |
| Refractive Index | 1.4 | 1.4 | 1.4 | 1.4 | 1.4 |
| Density @ 40° C. | 0.82174 | 0.83064 | — | 0.84861 | 0.85798 |
| Density @ 65° C. | 0.8066 | 0.81548 | 0.82432 | 0.83346 | 0.84277 |

TABLE 2

| Properties | GTL |
|---|---|
| Kinematic Viscosity @ 40° C., cSt | 99.38 |
| Kinematic Viscosity @ 100° C., cSt | 14.84 |
| Viscosity Index | 156 |
| Cold Crank Viscosity @ −25° C., cP | 13,152 |
| Pour Point, ° C. | −12 |
| Cloud Point, ° C. | 15 |

TABLE 2-continued

| Properties | GTL |
|---|---|
| n-d-m | |
| Molecular Weight, gm/mol (VPO) | 697 |
| Density, gm/ml | 0.8317 |
| Refractive Index | 1.4636 |
| Paraffinic Carbon, % | 93.44 |
| Naphthenic Carbon, % | 6.56 |
| Aromatic Carbon, % | 0.00 |
| Oxidator BN, hrs | 35.27 |
| ANTEK SULFUR | <1 |
| LOW LEVEL NITROGEN | <0.1 |
| Noack, wt. % | 1 |
| Saybolt Color | 24 |
| COC Flash Point, ° C. | 210 |
| SIMDIST TBP (WT %), F. | |
| TBP @ 0.5 | 879 |
| TBP @ 5 | 935 |
| TBP @ 10 | 963 |
| TBP @ 20 | 997 |
| TBP @ 30 | 1021 |
| TBP @ 40 | 1042 |
| TBP @ 50 | 1060 |
| TBP @ 60 | 1079 |
| TBP @ 70 | 1099 |
| TBP @ 80 | 1122 |
| TBP @ 90 | 1153 |
| TBP @ 95 | 1175 |
| TBP @ 99.5 | 1219 |
| FIMS (Introduction method, run number) | Probe tof991 |
| Saturates | 69.7 |
| 1-Unsaturation | 29.6 |
| 2-Unsaturation | 0.7 |
| Branching Index | 21.66 |
| Branching Proximity | 21.45 |
| Alkyl Branches per Molecule | 3.7 |
| Methyl Branches per Molecule | 2.85 |
| Alkyl Branches per 100 Carbons | 7.43 |
| Methyl Branches per 100 Carbons | 5.73 |
| % Olefins by Proton NMR | 2 |

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value. The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the endpoints and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A gear oil composition, comprising:

a) a base oil comprising a mixture of at least an isomerized base oil having consecutive numbers of carbon atoms and less than 10 wt % naphthenic carbon by n-d-M and a mineral oil having a kinematic viscosity of 3 to 120 mm2/s at 100° C. and a viscosity index of at least 60, the isomerized base oil having a viscosity index greater than 28×Ln (Kinematic Viscosity at 100° C., in mm2/s)+300;

b) 0.001 to 30 wt % at least an additive selected from traction reducers, dispersants, viscosity modifiers, pour point depressants, antifoaming agents, antioxidants, rust inhibitors, metal passivators, extreme pressure agents, friction modifiers, and mixtures thereof;

wherein the isomerized base oil is present in a synergistic amount for the gear oil composition to have a traction coefficient at 15 mm2/s. of less than 0.030 at a slide to roll ratio of 40 percent and a pressure viscosity coefficient of at least 15.0 GPa-1 at 80° C., 20 Newton load, and 1.1 m/s rolling speed.

2. The composition of claim 1, wherein the isomerized base oil is present in a synergistic amount for the gear oil to have a pressure viscosity coefficient of at least 15.5 $GPa^{-1}$ in a temperature range of 70-100° C., 20, 20 Newton load, and 1.1 m/s rolling speed.

3. The composition of claim 1, wherein the isomerized base oil is present in an amount ranging from 20 to 75 wt. % based on the total weight of the gear oil composition.

4. The composition of claim 3, wherein the isomerized base oil is present in an amount ranging from 25 to 70 wt. % based on the total weight of the gear oil composition.

5. The composition of claim 4, wherein the isomerized base oil is present in an amount of 25 to 60 wt. % based on the total weight of the gear oil composition.

6. The composition of claim 1, wherein the gear oil composition has a traction coefficient at 15 $mm^2/s$. of less than 0.028 at a slide to roll ratio of 40 percent.

7. The composition of claim 1, wherein the gear oil composition has a film thickness of at least 175 nm at 80° C.

8. The composition of claim 7, wherein the gear oil composition has a film thickness of at least 160 nm at 90° C. or at least 130 nm at 100° C.

9. The composition of claim 1, wherein the isomerized base oil has a kinematic viscosity @40° C. in the range of 80-110 $mm^2/s$., a kinematic viscosity @100° C. of 10-16 $mm^2/s$., a viscosity index of 140-160, a pour point in the range of −0 to −40° C., an average molecular weight of 650-725, and a sulfur content of less than 1 ppm.

10. The composition of claim 1, wherein the mineral oil has a kinematic viscosity of 2.3 to 3.4 $mm^2/s$ at 100° C. and a % Cp defined by ASTM D 3238 (R2000) of 70 or higher.

11. The composition of claim 1, wherein the mineral oil has a kinematic viscosity of less than 80 $mm^2/s$ at 40° C., comprising a mixture of at least a mineral oil and a synthetic oil having and a kinematic viscosity of 3.5 to 7 $mm^2/s$ at 100° C.; and at least a mineral oil and a synthetic oil having a kinematic viscosity of 20 to 52 $mm^2/s$ at 100° C.

12. The composition of claim 1, wherein the mineral oil is a group II neutral base oil having a kinematic viscosity at 40° C. of 80-120 $mm^2/s$., a kinematic viscosity at 100° C. of 10 to 14 $mm^2/s$., and a viscosity index of 80-120.

13. The composition of claim 1, wherein isomerized base oil is a Fischer-Tropsch derived base oil made from a waxy feed, having an average molecular weight between 600 and 1100, and an average degree of branching in the molecules between 6.5 and 10 alkyl branches per 100 carbon atoms.

14. The composition of claim 1, wherein isomerized base oil has a wt. % Noack volatility between 0 and 100 and an auto-ignition temperature (AIT) greater than an amount defined by: 1.6×(Kinematic Viscosity at 40° C., in $mm^2/s$)+300.

15. The composition of claim 1, wherein the isomerized base oil has an auto-ignition temperature (AIT) greater than 329° C. and a traction coefficient of less than 0.023 when measured at a kinematic viscosity of 15 $mm^2/s$ and at a slide to roll ratio of 40%.

16. The composition of claim 1, wherein the isomerized base oil has a total weight percent of molecules with cycloparaffinic functionality of greater than 10, and a ratio of weight percent molecules with monocycloparaffinic functionality to weight percent molecules with multicycloparaffinic functionality of greater than 15.

17. The composition of claim 1, wherein the isomerized base oil is made from a process in which the highly paraffinic wax is hydroisomerized using a shape selective intermediate pore size molecular sieve comprising a noble metal hydrogenation component, and under conditions of about 600° C. to 750° C. of and wherein the isomerized base oil has a Noack volatility of less than 50 weight %.

18. The composition of claim 1, wherein the isomerized base oil is comprises greater than 3 weight % molecules with cycloparaffinic functionality and less than 0.30 weight percent aromatics.

19. The composition of claim 1, wherein the isomerized base oil has a Noack volatility less than an amount defined by: 160-40 (Kinematic Viscosity at 100° C.).

20. The composition of claim 1, wherein the isomerized base oil comprises greater than 10 wt. % and less than 70 wt. % total molecules with cycloparaffinic functionality.

* * * * *